US011364417B1

(12) United States Patent
Prejean

(10) Patent No.: US 11,364,417 B1
(45) Date of Patent: Jun. 21, 2022

(54) FOOT EXERCISE APPARATUS FOR ELIMINATING FLAT FEET

(71) Applicant: Dylan Prejean, Carencro, LA (US)

(72) Inventor: Dylan Prejean, Carencro, LA (US)

( * ) Notice: Subject to any disclaimer, the term of this patent is extended or adjusted under 35 U.S.C. 154(b) by 0 days.

(21) Appl. No.: 17/532,335

(22) Filed: Nov. 22, 2021

(51) Int. Cl.
*A63B 23/10* (2006.01)
*A63B 21/02* (2006.01)

(52) U.S. Cl.
CPC ..... *A63B 23/10* (2013.01); *A63B 21/023* (2013.01)

(58) Field of Classification Search
CPC ..... A63B 21/02; A63B 21/023; A63B 21/025; A63B 21/026; A63B 21/0407; A63B 21/0428; A63B 21/0442; A63B 21/05; A63B 21/4045; A63B 21/40; A63B 21/4011; A63B 21/4013; A63B 21/4015; A63B 21/4033; A63B 21/4034; A63B 23/10; A63B 23/04; A43B 3/12; A43B 3/128; A43B 7/26; A43B 13/41; A43B 23/081; A43B 5/0403; A43B 5/0409; A43B 5/0413; A43B 5/0415; A43B 5/0417; A43B 5/0421; A43B 5/0435–0439; A63C 10/02; A63C 10/14; A63C 10/18; A63C 10/20; A63C 10/08; A63C 10/16; A63C 10/22; A63C 9/002; A63C 9/005; A63C 9/082; A63C 9/084; A63C 9/8578; A63C 9/22
See application file for complete search history.

(56) References Cited

U.S. PATENT DOCUMENTS 1,671,096 A * 5/1928 Anderson ..... A63B 23/08 482/79
2,250,493 A * 7/1941 Milne ..... A63B 23/085 482/79
2,269,357 A * 1/1942 Dent ..... A63B 59/60 473/412
2,374,730 A * 5/1945 De Forest ..... A63B 22/0056 601/28
2,700,832 A * 2/1955 Slovinski ..... A63B 21/4015 36/97
2,760,774 A * 8/1956 Perez ..... A63B 21/4015 482/79
3,088,458 A * 5/1963 Stewart ..... A61H 15/00 601/122
3,937,481 A * 2/1976 Koleda ..... A63C 9/003 280/618

(Continued)

*Primary Examiner* — Garrett K Atkinson
*Assistant Examiner* — Kathleen M Fisk
(74) *Attorney, Agent, or Firm* — Dale J. Ream

(57) ABSTRACT

A foot exercise apparatus includes a non-slip base and a casing mounted atop the base, the casing having opposed front and rear rends and opposed side walls extending therebetween. A toe assembly is situated atop a top surface of the casing proximate the front end an includes a toe receiver having a cupped configuration and a stop for aligning a user's toes when standing atop the top surface. When a user contracts or pulls his toes back, the toe receiver is slidably movable between a rest configuration displaced a first distance from the front end and a deployed configuration displaced a second distance from the front end, the toe receiver being spring biased toward the rest configuration. A heel assembly is situated atop the top surface proximate the rear end and includes a toe receiver for receiving a user's heel and is slidably movable according to a user's foot length.

12 Claims, 5 Drawing Sheets

(56) References Cited

U.S. PATENT DOCUMENTS 3,992,037 A * 11/1976 Frechin ..... A43B 5/0417 36/117.3
4,403,785 A * 9/1983 Hottel ..... A63C 10/06 280/607
4,461,472 A * 7/1984 Martinez ..... A63B 23/10 482/79
4,465,295 A * 8/1984 Spademan ..... A63C 9/086 280/612
4,836,531 A * 6/1989 Niks ..... A63B 23/16 482/44
D325,968 S * 5/1992 Nofsinger ..... D24/213
5,413,543 A * 5/1995 Drago ..... A63B 23/16 482/79
5,505,477 A * 4/1996 Turner ..... A43B 5/0403 36/117.3
6,013,043 A * 1/2000 Forner ..... A63B 26/003 602/23
6,189,899 B1 * 2/2001 Carlson ..... A63C 10/18 280/14.22
6,638,176 B1 * 10/2003 Hayes ..... A63B 69/3667 473/266
8,075,456 B2 * 12/2011 Fugitt ..... A63B 21/4015 482/92
8,117,768 B2 * 2/2012 Bobbett ..... A43B 7/1405 36/94
8,360,940 B2 * 1/2013 Kole ..... A63B 21/02 482/79
9,220,941 B2 * 12/2015 Barry ..... A63B 21/4017
9,821,184 B1 * 11/2017 Chapman ..... A61H 1/024
2001/0036885 A1 * 11/2001 Castellot, Jr. ..... A63B 21/4015 482/79
2005/0248129 A1 * 11/2005 Pelchat ..... A63C 5/128 280/629
2007/0037672 A1 * 2/2007 Nakanishi ..... A63B 21/0428 482/121
2007/0096411 A1 * 5/2007 Rempe, II ..... A63C 10/06 280/32.5
2007/0277397 A1 * 12/2007 Chen ..... A43B 7/142 36/145
2008/0088114 A1 * 4/2008 Farges ..... A63C 9/005 280/617
2008/0199839 A1 * 8/2008 Fugitt ..... A63B 21/4015 434/247
2010/0018078 A1 * 1/2010 Bobbett ..... A43B 3/107 36/88
2010/0036296 A1 * 2/2010 Sancho Serrats .... A47C 16/025 601/31
2011/0124473 A1 * 5/2011 Kole ..... A63B 21/02 482/79
2011/0256983 A1 * 10/2011 Malack ..... A63B 21/4015 482/4
2012/0143101 A1 * 6/2012 Schmidt ..... A61H 1/0244 601/5
2012/0190515 A1 * 7/2012 Barry ..... A63B 21/055 482/139
2013/0118037 A1 * 5/2013 Bathum ..... A43B 9/00 12/146 B
2014/0336012 A1 * 11/2014 Gourineni ..... A43B 7/1425 482/79
2015/0297943 A1 * 10/2015 Yeh ..... A63B 22/0076 74/594.7
2017/0128775 A1 * 5/2017 Santos ..... A63B 71/0622
2018/0290009 A1 * 10/2018 Avila ..... A61H 1/0244
2019/0015698 A1 * 1/2019 Fitzsimmons ..... A63B 23/10
2019/0160322 A1 * 5/2019 McCarthy ..... A63B 69/0062

* cited by examiner

FOOT EXERCISE APPARATUS FOR ELIMINATING FLAT FEET

BACKGROUND OF THE INVENTION

This invention relates generally to medical devices and, more particularly, to a foot exercise method and apparatus for therapeutic or home treatment to decrease, prevent, or reverse symptoms of having flat feet.

Flat feet (also referred to as pes planus or fallen arches) is a foot deformity in which the otherwise natural arches of a foot collapse and the entire (or nearly entire) sole of one's foot contacts the floor or ground surface. The condition of flat feet may be caused by obesity, arthritis, aging, genetics, muscular disease, injuries, and even pregnancy. Working to treat flat feet is desirable to avoid the pain, stress, and imbalance that may be caused when a human body is not in perfect alignment.

Various exercises and devices have been proposed in the prior art for treating the condition of flat feet, including heel stretches (also referred to as calf stretches), calf raises, tennis ball rules, towel curls, arch lifts, toe raises, or wearing an orthotic device. Although presumably effective for their intended purposes, there is still a need for a superior exercise apparatus that enables a user's toes to be contracted or pulled rearwardly in the direction of a bottom of the foot and against the natural compression strength of a spring. This resistance exercise of a user's toes is effective to mitigate the effects of flat feet.

Therefore, it would be desirable to have an exercise device that enables a user to exercise the tendons in a foot that are associated with the condition of flat feet through repeated contractions of the toes against resistance. Further, it would be desirable to have an exercise device that is length adjustable to fit a user's foot.

SUMMARY OF THE INVENTION

A foot exercise apparatus for persons with flat feet according to the present invention includes a base having a lower surface constructed of a non-slip material and a casing mounted atop the base, the casing having opposed front and rear rends and opposed side walls extending between the front and rear ends. A toe assembly is situated atop a top surface of the casing proximate the front end and includes a toe receiver having a cupped or arched configuration and a stop for aligning a user's toes when standing atop the top surface. When a user contracts or pulls his toes back, the toe receiver is slidably movable between a rest configuration displaced a first distance from the front end and a deployed configuration displaced a second distance from the front end, the toe receiver being spring biased toward the rest configuration. A heel assembly is situated atop the top surface proximate the rear end an includes a toe receiver having a cupped or arched configuration for receiving a user's heel and is slidably movable according to a user's foot length.

In use, a person may cradle his heel in the heel receiver and adjust its longitudinal position so that his toes reach just forward of the toe receiver. Then, a pulling back or contraction of the user's toes slidably articulates the toe portion rearwardly according to a predetermined resistance of a compression spring, the toe receiver being spring-biased to return to its rest configuration.

Therefore, a general object of this invention is to provide a foot exercise apparatus that enables a user to flex or contract his toes against a predetermined amount of resistance so as to decrease or eliminate fallen arches in his feet, otherwise known as "flat feet."

Another object of this invention is to provide a foot exercise apparatus, as aforesaid, having a heel assembly that is longitudinally adjustable to a selectable foot length.

Still another object of this invention is to provide a foot exercise apparatus, as aforesaid, that includes a toe assembly having a toe receiver that is movable against the pressure of a compression spring between a rest configuration and a deployed configuration, the toe receiver being spring biased toward the rest configuration. This movement is caused by contraction or pulling back of a user's toes.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
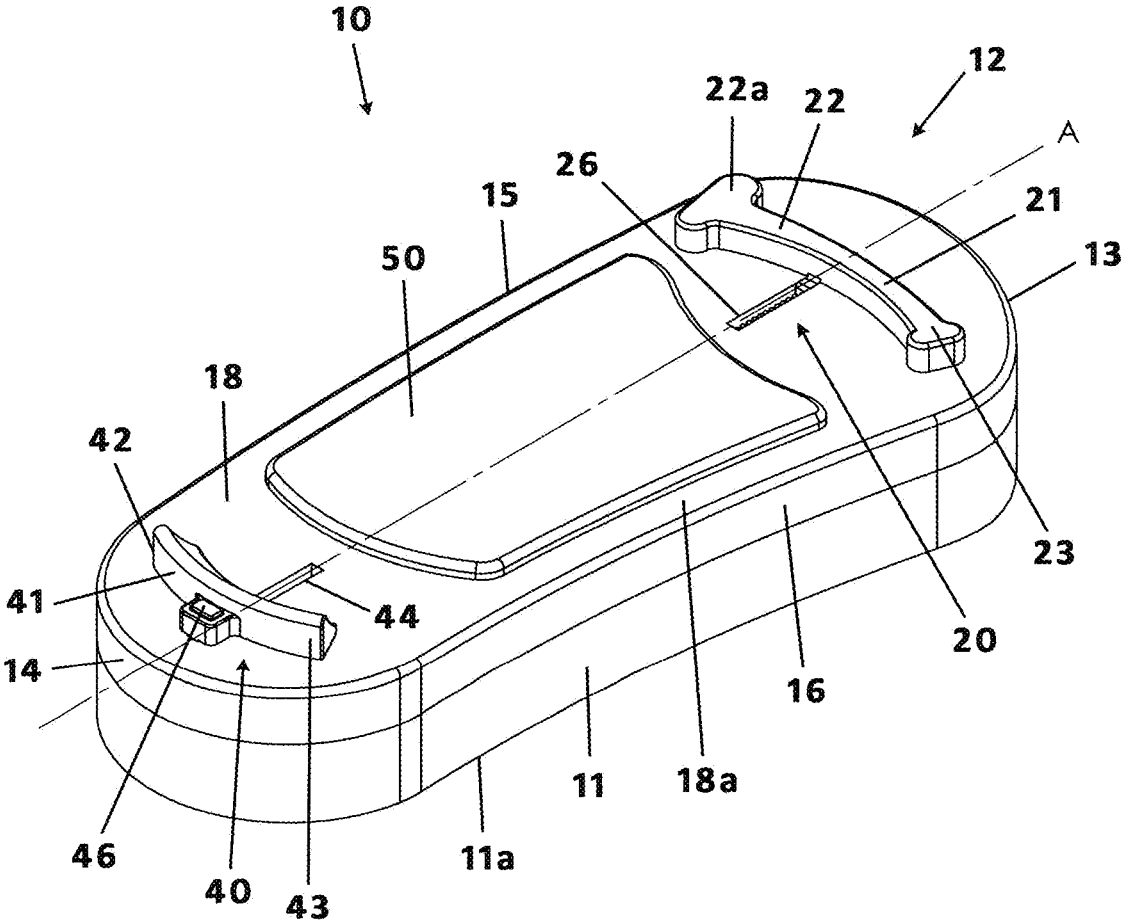
FIG. 1 is a perspective view of a foot exercise apparatus according to a preferred embodiment of the present invention.

A foot exercise device according to a preferred embodiment of the present invention will now be described with reference to FIGS. 1 to 3*d* of the accompanying drawings. The foot exercise apparatus 10 may include a base 11, a casing 12, a toe assembly 20, a heel assembly 40, and appropriate linkages for longitudinal adjustment of the toe and heel assemblies.

The toe assembly 20 and heel assembly 40 are situated atop a casing 12 that, in an embodiment, may be constructed of a plastic material and define a shape configuration indicative of the shape of a human foot. In other embodiments, however, the casing 12 may be constructed of a lightweight metal or even a rapid prototype material. More particularly, the casing 12 has a front end 13 and a rear end 14 opposite the front end 13 and may include a top surface 18 having a generally planar configuration. Further, the casing 12 may include a bottom surface 19 that is opposite and parallel to the top surface 18. The casing 12 may also include a left sidewall 15 and a right sidewall 16 that extend between said top surface 18 and said bottom surface 19 as well as between said front and rear ends 13, 14, respectively. Therefore, the casing 12 has a thickness and defines a pair of channels and a pair of open spaces for housing linkages associated with the toe and heel assemblies as will be described below. The top surface 18 may include a center section designated with reference 18*a* to be used later for clarity.

The toe assembly 20 is coupled to the top surface 18 and generally proximate the front end 13 of the casing 12. Preferably, the toe assembly 20 is displaced slightly from the front end 13. The toe assembly 20 includes a toe receiver 21 having a first end 22 proximate the left sidewall 15 and a second end 23 proximate the right sidewall 16 and has a body section extending therebetween. In an embodiment, the toe receiver 21 may have an arched or cupped configuration when viewed relative to the center section 18*a* of the top surface 18. The curved configuration of the toe receiver 21 may also be described as having a concave configuration relative to the center section 18*a* or relative to the heel receiver 41 that will be described in more detail later. In an embodiment, the front end 13 and rear end 14 may have gently rounded configurations and the left and right sidewalls 15, 16 may be curved inwardly such that the casing 12, as a whole, is indicative of or complementary to a human foot.

As shown in FIG. 1, the first end 22 of the toe receiver 21 may include a stop 22*a* (which may also be referred to as a tab or extension) that extends forwardly the direction of the front end 13 of the casing 12. The stop 22*a* enables the user, using only the sense of touch, to properly align and maintain his toes over and atop the toe receiver 21 when standing atop the top surface 18 of the casing 12 as will be explained in more detail later. Also as shown in FIG. 1, the toe receiver 21 extends upwardly or away from the top surface 18 and essentially being perpendicular to the planar surface thereof.

For the sake of clarity, the casing defines an imaginary longitudinal axis extending linearly between the front end 13 and rear end 14 and is centered between left and right sidewalls 15, 16. In an embodiment, the top surface 18 defines a toe channel 26 along the imaginary longitudinal axis that is perpendicular to and adjacent to the toe receiver 21. It is understood that the toe channel 26 is recessed or cut into the top surface 18. Further, a compression spring 27 is situated in the toe channel 26 so as inaccessible to a user or any other unintended access. The compression spring 27 and toe channel 26 have a linear configuration with one end of the spring positioned at an inner end of the toe channel 26 and an opposed end in communication with the toe receiver 21.

Figure 2A:
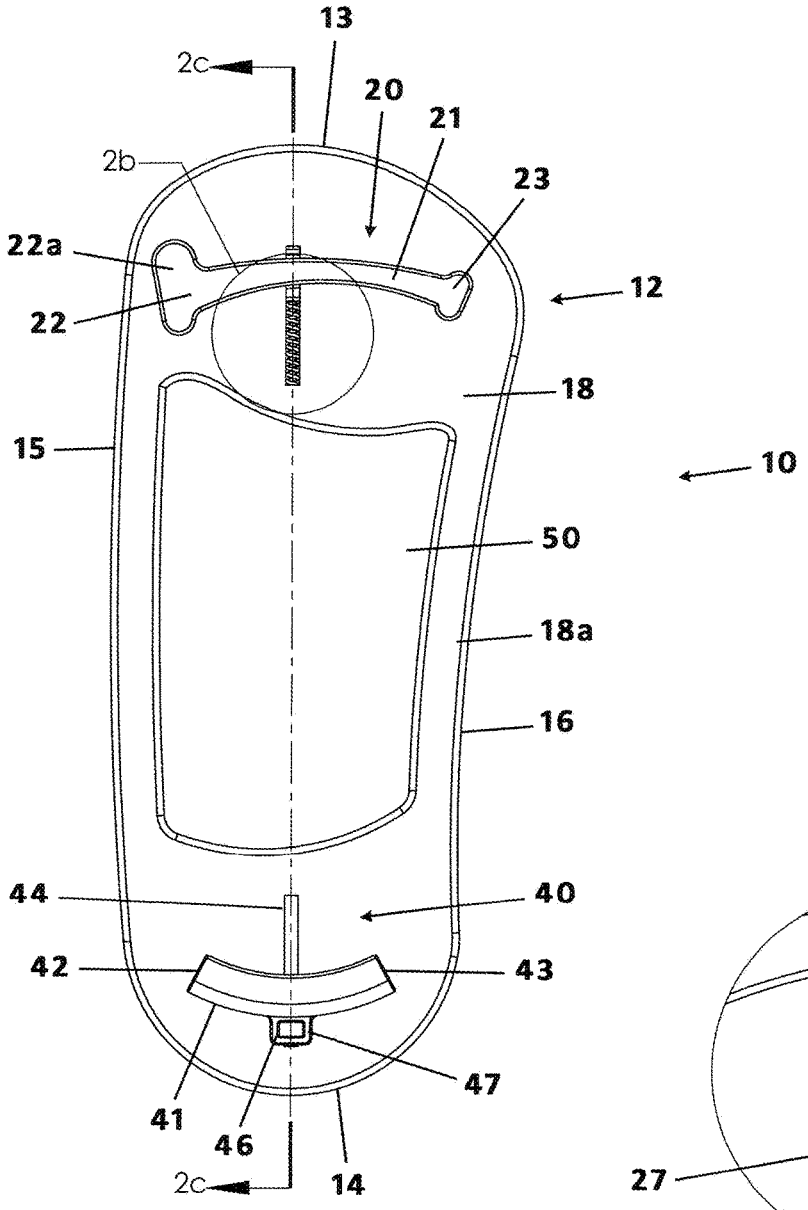
FIG. 2*a* is a top view of the apparatus as in FIG. 1.
Figure 2B:
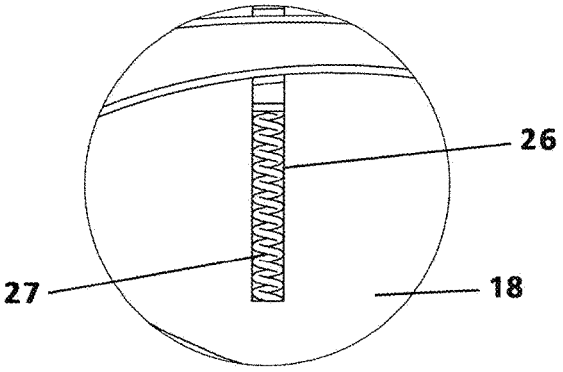
FIG. 2*b* is an isolated view on an enlarged scale taken from FIG. 2*b;*
Figure 2C:
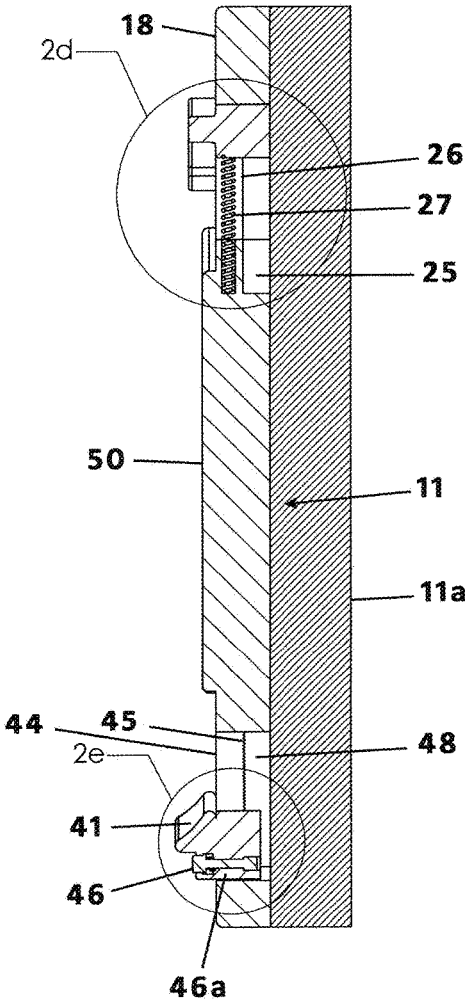
FIG. 2*c* is a sectional view taken along line 2*c*-2*c* of FIG. 2*a;*
Figure 2D:
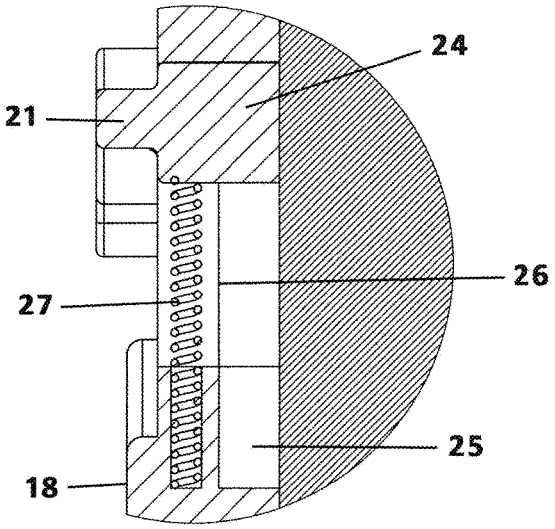
FIG. 2*d* is an isolated view on an enlarged scale taken from FIG. 2*c;*
Figure 2E:
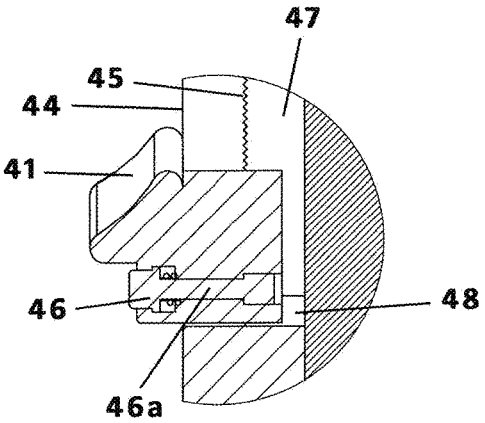
FIG. 2*e* is an isolated view on an enlarged scale taken from FIG. 2*c;*

More particularly, the casing 12 defines a first interior space 25 adjacent the toe channel 26. The toe receiver 21 may include a mounting portion 24 situated in the first interior space 25 and coupled to the opposed end of the compression spring 27. The mounting portion 24 is movable within this first interior space 25. Accordingly, the toe receiver 21, including the mounting portion 24, is slidably movable along the imaginary longitudinal axis between a rest configuration substantially adjacent the front end 13 of the casing 12 (FIG. 1) and a deployed configuration substantially displaced from the front end 13 (FIG. 2*a*). The compression spring 27 is incrementally compressed as the mounting portion 24 of the toe receiver 21 is moved from the rest configuration toward the deployed configuration. The toe receiver 21 may be moved inwardly in the direction toward the heel receiver 41 when a user's toes are contracted or pulled inwardly, as will be described in more detail later Then, when the actuation pressure is removed or released from the toe receiver 21, the compression spring 27 naturally expands to push the toe receiver 21 back to the rest configuration. Explained another way, the toe receiver 21 may be articulated to move along the toe channel 26 from a rest configuration that is a first distance from the front end 13 to a deployed configuration that is a second distance from the front end 13, it being understood that the second distance is greater than the first distance. It is also understood that the compression spring 27 is incrementally compressed as the toe receiver 21 is articulated but then normally pushes back and returns the toe receiver 21 to the rest configuration when a user's toes are released.

The heel assembly 40 is situated atop the top surface 18 and proximate the rear end 14 of the casing 12 and has a configuration that, in structure and function, is similar to that of the toe assembly 20 except as described below. The heel assembly includes a heel receiver 41 that is slidably adjustable to a selected distance between the heel receiver 41 and the toe receiver 21 as may correlate with a length of a user's foot (FIG. 1). More particularly, the heel receiver includes opposed first and second ends 42, 43 and has a body section extending therebetween. In an embodiment, the heel receiver 41 may have an arched or cupped configuration when viewed relative to the center section 18*a* of the top surface 18. The curved configuration of the heel receiver 41 may also be described as having a concave configuration relative to the center section 18*a* or relative to the toe receiver 21. In general, the heel receiver 41 has a configuration for cupping or nesting the heel of a user. The heel receiver 41 extends upwardly or away from the top surface 18 and is essentially perpendicular thereto.

Figure 3A:
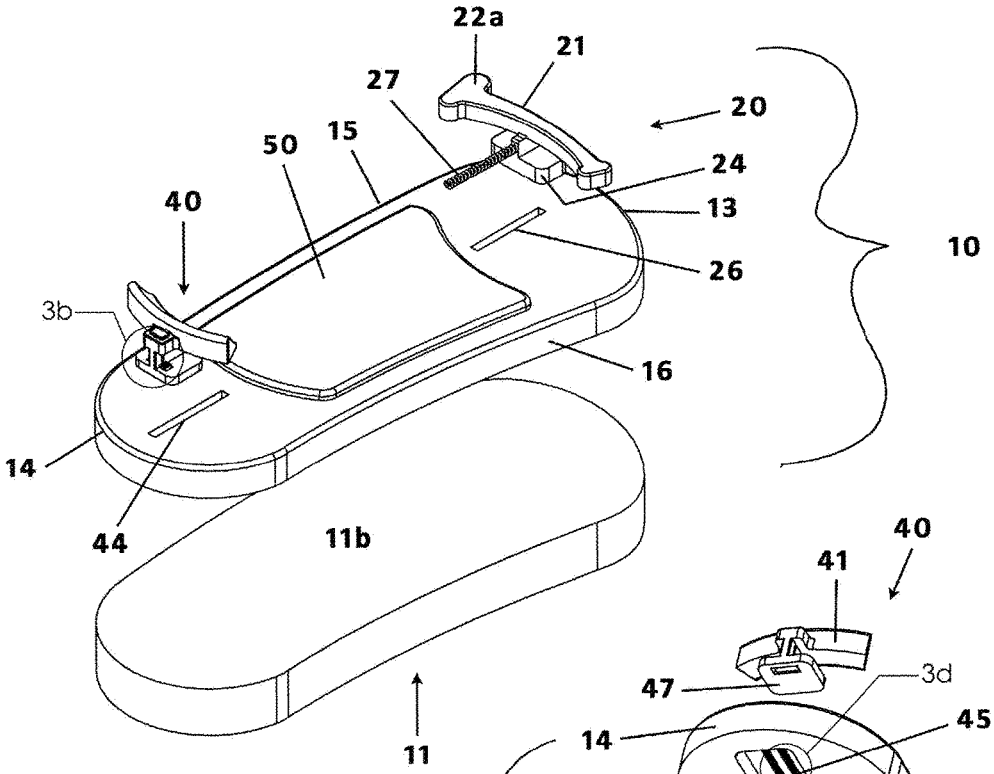
FIG. 3*a* is an exploded view from an upper perspective of the apparatus as in FIG. 1.
Figure 3C:
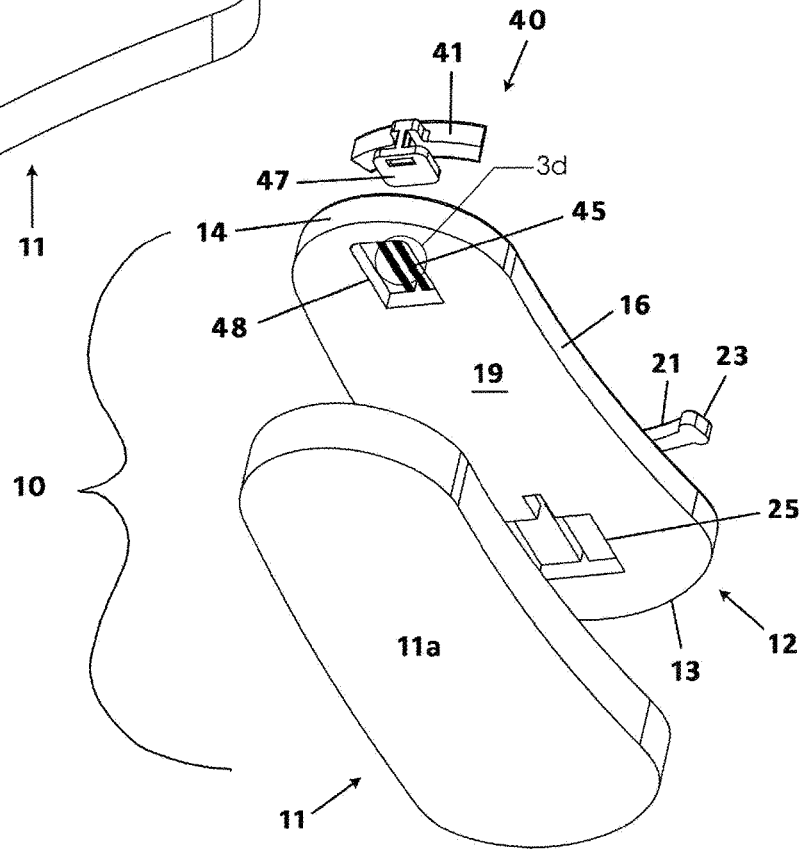
FIG. 3*c* is an exploded view from a lower perspective of the apparatus as in FIG. 1.
Figure 3B:
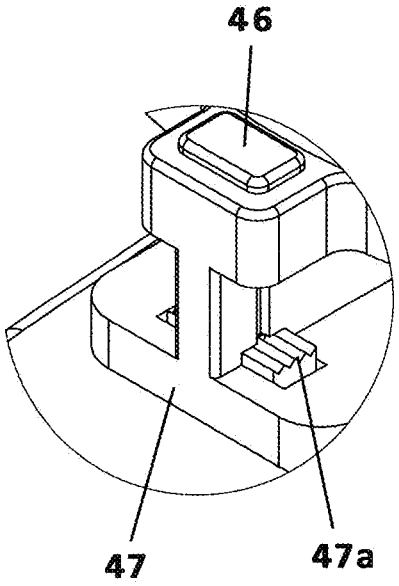
FIG. 3*b* is an isolated view on an enlarged scale taken from FIG. 3*a;*
Figure 3D:
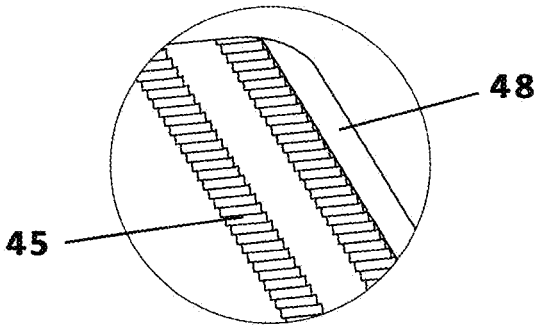
FIG. 3*d* is an isolated view on an enlarged scale taken from FIG. 3*c*.

Turning now to FIGS. 3*a* and 3*b*, the linkage for movement of the heel receiver 41 will be described in more detail. First, the top surface 18 defines and adjustment channel 44 extending perpendicularly and linearly away from the heel receiver 41, the adjustment channel 44 being situated along the longitudinal axis and in communication with the heel receiver 41. The adjustment channel 44 further defines a plurality of locking teeth 45 (FIG. 3*c*). Further, the heel assembly 40 includes a position adjustment member in communication with the heel receiver 41 and with the plurality of locking teeth 45. In an embodiment, the position adjustment member includes a lock button 46 that is spring-loaded with spring 46*a* and selectively movable between an actuated configuration allowing the position adjustment member 47 to slide along the plurality of locking teeth 45 (so as to select an adjustment position) and a released configuration preventing further sliding of the position adjustment member 47. In other words, the lock button 46 may be depressed allowing a user to slide the heel receiver 41 inwardly toward the center section 18*a* and then releasing the lock button 46 when the length adjustment is complete and thus, enabling the lock button 46, by action of spring 46*a*) to automatically spring back to an uncompressed configuration and to lock in the length adjustment. Still further, the casing 12 defines a second interior space 48 proximate the adjustment channel 44 and the plurality of locking teeth 45. The position adjustment member 47 includes a lock engagement section situated in the second interior space 48 and has a configuration for selectively engaging with the locking teeth 45 when the lock button 46 is released (FIG. 3*b*). In an embodiment, the lock engagement section of the position adjustment member 47 may include one or more engagement teeth 47*a* configured to selectively engage the plurality of locking teeth 45 when the lock button 46 is released but to separate them when actuated. The lock button 46 may be operatively coupled to the position adjustment member 47 via a linkage.

In addition, the foot exercise apparatus 10 includes a pad 50 coupled to the center section 18*a* of the top surface 18 of the casing 12. It is understood that the pad 50 may be large enough to substantially cover the top surface 18 between the toe assembly 20 and the heel assembly 40. Preferably, the pad 50 is constructed of cotton, flannel, wool, foam, gel, or combinations thereof. In any case, the pad 50 is critical so as to be comfortable, warm, and ergonomic on which a person will stand.

Finally, the foot exercise apparatus 10 may include a base 11 that is, in one embodiment, entirely constructed of a non-slip rubber material and a top which the casing 12 may be fixedly or removably attached. It is critical that the casing 12 not slip on a floor surface and become a hazard to a user standing upon the casing. In another embodiment, at least a lower surface 11*a* of the base 11 includes a non-slip rubber surface that resists sliding. The base 11 may also include in upper surface 11*b* that may be coupled to a bottom surface 19 of the casing 12. Preferably, the base 11 has a perimeter configuration that is identical to that of the casing 12, e.g., that which is indicative of a human foot.

In use, the foot exercise apparatus 10 is used to exercise appropriate tendons of the foot so as to decrease or eliminate the pain associated with flat feet. In general, the foot exercise apparatus 10 may be used by a patient to repeatedly contract and release his toes under resistance supplied by a compression spring 27. More specifically, the method according to the present invention involves a user positioning his foot atop the top surface 18 of the casing 12, receiving a user's heel by the heel receiver 41 and, if necessary, repositioning the heel receiver 41 such that the user's toes are aligned atop the toe assembly 20. Then, a contraction or pulling back of the user's toes causes the slidable movement of the toe receiver 21 from its rest configuration substantially adjacent the front end 13 toward the deployed configuration further displaced from the front end 13. Finally, the toe receiver 21, is returned to the rest configuration when a user releases contraction of his toes.

Accordingly, the foot exercise apparatus rule 10 and method of use thereof has the useful purpose of preventing, treating, and improving the deleterious effects of flat feet.

It is understood that while certain forms of this invention have been illustrated and described, it is not limited thereto except insofar as such limitations are included in the following claims and allowable functional equivalents thereof.

The invention claimed is:

1. A foot exercise apparatus for persons with flat feet, comprising:

a casing having a front end and a rear end opposite said front end and a top surface extending between said front and rear ends;

a toe assembly positioned proximate said front end and atop said top surface, said toe assembly having a toe receiver that is slidably movable along an imaginary longitudinal axis from a rest configuration adjacent said front end and a deployed configuration displaced from said front end, said toe receiver being naturally biased toward said rest configuration; and a heel assembly positioned proximate said rear end and atop said top surface, said heel assembly having a heel receiver that is slidably adjustable to a selected distance from said toe receiver when at said rest configuration;

wherein:

said casing includes a left sidewall and a right sidewall opposite said left sidewall, said left and right sidewalls extending between said front end and said rear end;

said toe receiver has opposed first and second ends and extends substantially between said left and right sidewalls, respectively, and has a cupped configuration relative to a center section of said top surface, said toe receiver extending away from said top surface of said casing and being perpendicular thereto;

said toe assembly includes a compression spring situated in a channel defined by said top surface in communication with an inner surface of said toe receiver, said compression spring having a predetermined level of resistance and being configured to normally bias said toe receiver toward said rest configuration;

said heel receiver has opposed first and second ends and extends substantially between said left and right sidewalls, respectively, and has a cupped configuration relative to said center section, said heel receiver extending away from said top surface of said casing and being perpendicular thereto;

said top surface defines an adjustment channel in communication with an inner surface of said heel receiver, said adjustment channel having a plurality of locking teeth;

said heel assembly includes a position adjustment member in communication with said plurality of locking teeth, said position adjustment member having a lock button that is spring-loaded and selectively movable between an actuated configuration allowing said position adjustment member to slide along said plurality of locking teeth and a released configuration preventing said position adjustment member from moving; and said lock button is biased toward said released configuration.

2. The foot exercise apparatus as in claim 1, wherein:

said channel is recessed into said top surface so as to block access to said compression spring; and said channel has a linear configuration and is positioned along said imaginary longitudinal axis.

3. The foot exercise apparatus as in claim 1, wherein said first end of said toe receiver includes a stop that extends toward said front end of said casing for aligning toes of a user on said toe receiver.

4. The foot exercise apparatus as in claim 1, wherein:

said casing defines a first interior space adjacent said channel; and said toe receiver includes a mounting portion situated in said first interior space and is coupled to said compression spring, said mounting portion being slidably movable within said first interior space when said toe receiver is moved toward said deployed configuration so as to compress said compression spring.

5. The foot exercise apparatus as in claim 1, wherein:

said top surface defines a second interior space; and said position adjustment member includes a lock engagement section situated in said second interior space and in communication with said plurality of locking teeth.

6. The foot exercise apparatus as in claim 1, further comprising a pad fixedly coupled to said top surface of said casing, said pad having a planar configuration.

7. The foot exercise apparatus as in claim 1, further comprising a base constructed of a non-slip rubber material;

wherein said casing is mounted atop said base; and wherein said casing and said base have a shape configuration complementary to a human foot.

8. A foot exercise apparatus for persons with flat feet, comprising:

a base having a lower surface constructed of a non-slip material and an upper surface opposite and parallel to said lower surface, said upper and lower surfaces having a planar configuration;

a casing having a front end and a rear end opposite said front end and a top surface extending between said front and rear ends, said casing being mounted atop said upper surface of said base;

a toe assembly positioned atop said top surface proximate said front end of said casing, said toe assembly having a toe receiver that is slidably movable along an imaginary longitudinal axis between a rest configuration displaced a first distance from said front end and a deployed configuration displaced a second distance from said front end, said toe receiver being naturally biased toward said rest configuration;

a heel assembly positioned proximate said rear end and atop said top surface, said heel assembly having a heel receiver that is slidably adjustable to a selected distance displaced from said rear end;

wherein:

said casing includes a left sidewall and a right sidewall opposite said left sidewall, said left and right sidewalls extending between said front end and said rear end;

said toe receiver has opposed first and second ends and extends substantially between said left and right sidewalls, respectively, and has a cupped configuration relative to a center section of said top surface, said toe receiver extending away from said top surface of said casing and being perpendicular thereto; and said toe assembly includes a compression spring situated in a channel defined by said top surface in communication with an inner surface of said toe receiver, said compression spring having a predetermined level of resistance and configured to normally bias said toe receiver toward said rest configuration;

said heel receiver has opposed first and second ends and extends substantially between said left and right sidewalls, respectively, and has a cupped configuration relative to said center section, said heel receiver extending away from said top surface of said casing and being perpendicular thereto; and said top surface defines an adjustment channel in communication with an inner surface of said heel receiver, said adjustment channel having a plurality of locking teeth;

said heel assembly includes a position adjustment member in communication with said plurality of locking teeth, said position adjustment member having a lock button that is spring-loaded and selectively movable between an actuated configuration allowing said position adjustment member to slide along said plurality of locking teeth and a released configuration preventing said position adjustment member from moving; and said lock button is biased toward said released configuration.

9. The foot exercise apparatus as in claim 8, wherein:

said casing defines a second interior space;

said position adjustment member includes a lock engagement section situated in said second interior space and in communication with said plurality of locking teeth.

10. The foot exercise apparatus as in claim 9, further comprising a pad fixedly coupled to said top surface of said casing, said pad having a planar configuration.

11. The foot exercise apparatus as in claim 8, wherein:

said channel is recessed into said top surface so as to block access to said compression spring;

said channel has a linear configuration and is positioned along said imaginary longitudinal axis;

said casing defines a first interior space adjacent said channel; and said toe receiver includes a mounting portion situated in said first interior space and is coupled to said compression spring, said mounting portion being slidably movable within said first interior space when said toe receiver is moved toward said deployed configuration so as to compress said compression spring.

12. The foot exercise apparatus as in claim 8, wherein said first end of said toe receiver includes a stop that extends toward said front end of said casing for aligning a user's toes on said toe receiver.

* * * * *